US006563258B2

(12) United States Patent
Miura et al.

(10) Patent No.: US 6,563,258 B2
(45) Date of Patent: May 13, 2003

(54) COLOR CATHODE RAY TUBE HAVING AN IMPROVED ELECTRON GUN ELECTRODE

(75) Inventors: Masato Miura, Mobara (JP); Takeshi Mera, Mobara (JP)

(73) Assignees: Hitachi, Ltd., Tokyo (JP); Hitachi Electronic Devices Co. Ltd., Tokyo (JP)

( * ) Notice: Subject to any disclaimer, the term of this patent is extended or adjusted under 35 U.S.C. 154(b) by 256 days.

(21) Appl. No.: 09/737,852

(22) Filed: Dec. 18, 2000

(65) Prior Publication Data

US 2001/0004187 A1 Jun. 21, 2001

(30) Foreign Application Priority Data

Dec. 17, 1999 (JP) ..... 11-358906

(51) Int. Cl.[7] ..... H01J 1/02
(52) U.S. Cl. ..... 313/414; 313/412
(58) Field of Search ..... 313/414, 417, 313/421, 409, 412, 448, 449

(56) References Cited

U.S. PATENT DOCUMENTS 5,677,590 A * 10/1997 Matsuda et al. ..... 313/412
5,877,587 A * 3/1999 Trinchero et al. ..... 313/414
6,144,151 A * 11/2000 Tojo et al. ..... 313/414
6,476,543 B1 * 11/2002 Mera et al. ..... 313/414

* cited by examiner

*Primary Examiner*—Robert H. Kim
*Assistant Examiner*—Elizabeth Gemmell
(74) *Attorney, Agent, or Firm*—Antonelli,Terry,Stout, & Kraus, LLP

(57) ABSTRACT

A color cathode ray tube has a phosphor screen and an electron gun. The electron gun includes an electron beam generating section for emitting three in-line electron beams toward the phosphor screen and an electron beam focusing section for focusing the electron beams onto the phosphor screen. The electron beam focusing section includes at least one cup-shaped electrode having a tubular portion and a flange formed continuously from the tubular portion. The tubular portion has a generally rectangular cross section having an outwardly curved portion at each side thereof in a direction of arrangement of the three in-line electron beams in a plane perpendicular to the color cathode ray tube axis, the flange has a generally rectangular cross section having an outwardly curved portion at each side thereof in the direction of arrangement of the electron beams in the plane perpendicular to the color cathode ray tube axis, and the flange is formed with a locally thinned-down portion.

10 Claims, 6 Drawing Sheets

COLOR CATHODE RAY TUBE HAVING AN IMPROVED ELECTRON GUN ELECTRODE

BACKGROUND OF THE INVENTION

The present invention relates to a color cathode ray tube, and in particular to a cathode ray tube capable of improving withstand voltage characteristics and displaying high-resolution color images by ensuring of high precision of dimensions and shapes of cup-shaped electrodes among a plurality of electrodes of an electron gun housed in its vacuum envelope.

Color cathode ray tubes such as a color picture tube and a display tube, which are typical cathode ray tubes, are widely used for reception of TV broadcast and monitors of various kinds of information processing equipment because of their high-definition image reproduction capability.

Color cathode ray tubes of such a kind have a vacuum envelope comprised of a panel, a neck and a funnel for connecting the panel and the neck, a phosphor screen formed on an inner surface of the panel, and an electron gun housed in the neck for projecting electron beams toward the phosphor screen. Especially, widely used are color cathode ray tubes employing an in-line type electron gun for projecting a plurality of electron beams parallel with each other in a horizontal plane.

FIG. 5 is a side view of an essential part of an embodiment of a configuration of an in-line type electron gun used for a color cathode ray tube, viewed in a direction perpendicular to a direction of the in-line arrangement of the electron beams.

In FIG. 5, reference numeral 31 denotes cathodes, 32 is a first electrode serving as a control electrode, 33 is a second electrode serving as an accelerating electrode, and the cathodes 31, the first electrode 32 and the second electrode 33 form an electron beam generating section. Reference numeral 34 denotes a third electrode, and 35 is a fourth electrode.

In this example, the fourth electrode 35 is formed of two cup-shaped electrodes 35*a* and 35*b*, and they serve as two focus electrodes. Reference numeral 36 denotes a fifth electrode, and the fifth electrode 36 and the cup-shaped electrode 35*b* of the fourth electrode 35 form a main lens therebetween. Reference numeral 37 denotes a shield cup, which is welded to the fifth electrode 36. The cathodes 31 and the first to fifth electrodes 32–36 are spaced with predetermined spacings and fixed in the predetermined order by a pair of insulator support rods (multiform glasses) 38.

Reference numeral 39 denotes a stem, and the cathodes and the electrodes are supplied with display signals or operating voltages via stem pins 40 sealed through the stem 39. Three electron beams are generated by the electron beam generating section which is a triode section comprised of the cathodes 31, the first electrode 32 and the second electrode 33, and are accelerated and focused by the third electrode 34, the fourth electrode 35 and the fifth electrode 36 such that the three electron beams are subjected to a desired focusing action by the main lens formed between opposing end faces of the fifth electrode 36 and the electrode 35*b* of the fourth electrode 35 and then directed toward the phosphor screen.

In this type of an electron gun, the first electrode 32 and the second electrode 33 are plate-like electrodes, and the third electrode 34, the fourth electrode 35 and the fifth electrode 36 are cup-shaped single-electrodes, respectively, or compound electrodes fabricated by welding together plural electrode members including a cup-shaped electrode member and a plate-like member, respectively.

FIGS. 6A to 6C are illustrations for explaining details of the fifth electrode 36 which is one of cup-shaped electrodes used in the electron gun of FIG. 5, FIG. 6A is a plan view of the fifth electrode 36, FIG. 6B is a front view thereof, and FIG. 6C is a cross-sectional view of the fifth electrode 36 taken along line VIC—VIC of FIG. 6A.

As shown in FIGS. 6A to 6C, the cup-shaped fifth electrode 36 has a generally rectangular flange 36*f* and a tubular portion 36*b* rising approximately perpendicularly and continuously from the flange 36*f*. The tubular portion 36*b* has an approximately oval opening in a cross section perpendicular to an axis 36*c* of the tubular portion 36*b*, that is, an approximately oval opening of the shape having two arcs 36*b*1 at both ends thereof and two straight lines 36*b*2 at the central portions joining the two arcs 36*b*1. The three electron beams pass through the approximately oval opening. Reference numeral 36*d* denotes a turned-up portion, which is turned up inwardly from a top surface 36*e* of the tubular portion 36*b* to extend toward the flange 36*f*. In some cup-shaped electrodes, the turned-up portion 36*d* is omitted.

The flange 36*f* comprises arc-shaped flange portions 36*f*1 and straight flange portions 36*f*2 which are formed outside of the tubular portions 36*b*. A structure of such a cup-shaped electrode is disclosed in Japanese Patent Application Laid-open No. Sho 55-74036 (laid-open on Jun. 4, 1980), for example.

Generally, such cup-shaped electrodes are fabricated by punching out sheets of desired dimensions from a long strip of a material, and then performing various operations such as the drawing of the sheets, heat treatment, and putting the drawn parts in final shape.

SUMMARY OF THE INVENTION

In the above prior art cup-shaped electrode, there has been a problem in that defects such as defective outside dimensions occur in the flange 36*f* after the drawing process, as indicated by broken lines 61, 62 in FIGS. 6A and 6B.

As described above, such cup-shaped electrodes are fabricated by the process steps including the drawing process steps. The tubular portion 36*b* has an approximately oval cross section in a plane perpendicular to the axis 36*c* of the tubular portion 36*b*, and consequently, in the drawing process step in which the tubular portion 36*b* is formed to rise from the flange 36*f*, the arc-shaped portions 36*w*1 of the tubular portion 36*b* are subjected to drawing action, but the straight portions 36*w*2 of the tubular portion 36*b* are subjected to bending, action, that is to say, the work piece is subjected to different forming actions depending upon the positions of the work piece in the same processing step. As a result, the arc-shaped portions 36*w*1 and the straight portions 36*w*2 differ from each other in the amount of excess material capable of flowing elsewhere, and consequently, the thickness of the arc-shaped flange portions 36*f*1 becomes greater than that of the straight flange portions 36*f*2.

The parts as drawn are subjected to heat treatment, and then are press-forming the whole parts including the flange 36*f* into final shape by using a die. If the parts of the above-mentioned shape were intended to be press-formed into final shape, it was difficult to ensure the flatness of the flange 36*f* and the parallelism of the flange 36*f* with the top surface 36*e*, and further the tubular portion 36*b* tilted with respect to the normal to the flange 36*f*, and as a result, the desired shapes and dimensions of the electrodes were not obtained, and further desired interelectrode spacings and concentricity between electron beam apertures which are important factors in withstand voltage and resolution characteristics could not be obtained in assembling the electron gun, and consequently adverse effects were caused to characteristics of the color cathode ray tube.

As measures to solve such various problems, there is a special technique to press-form the thick arc-shaped flange portions **36*f*1 by pressing the flange portions 36*f*1 against the shaping die strongly, but it complicates the processing steps and also the arc-shaped flange portions 36*f*1 expand locally and outwardly as indicated by broken lines 62 in FIG. 6A, and edges of the arc-shaped flange portions 36*f*1** become pointed in a longitudinal cross section and cause a problem in withstand voltage characteristics.

On the other hand, to prevent the above-mentioned local and outward expansions of the arc-shaped flange portions **36*f*1, it is necessary to reduce pressures in forming by using a die, but, in this case, there is a possibility that press-forming becomes insufficient. By this measure, it is difficult to ensure the flatness of the flange 36*f* and the parallelism of the flange 36*f* with the top surface 36*e*, and eliminate the tilt of the tubular portion 36*b* from the normal to the flange 36*f*,** and as a result, there have been various problems to be solved in that adverse effects were caused to characteristics of the color cathode ray tube.

It is an object of the present invention to solve the above-mentioned various problems with the above prior art and provide a color cathode ray tube provided with an electron gun employing a highly reliable electrode capable of forming the tubular portion perpendicularly to the flange, suppressing changes in outside dimensions of the flange, and ensuring the parallelism between the flange and the top surface of the tubular portion with high precision.

To achieve the above object, in accordance with an embodiment of the present invention, there is provided a color cathode ray tube comprising a vacuum envelope including a panel portion, a neck portion and a funnel portion for connecting the panel portion and the neck portion, a phosphor screen formed on an inner surface of the panel portion, and an electron gun housed in the neck portion, the electron gun comprising an electron beam generating section having a cathode, an electron beam control electrode and an accelerating electrode arranged in the order named for emitting three in-line electron beams toward the phosphor screen, and an electron beam focusing section for focusing the three in-line electron beams from the electron beam generating section onto the phosphor screen, the electron beam generating section and the electron beam focusing section being mounted in predetermined spaced relationship on a plurality of insulator support rods, the electron beam focusing section including at least one cup-shaped electrode having a tubular portion and a flange formed continuously from the tubular portion, the tubular portion having a generally rectangular cross section having an outwardly curved portion at each side thereof in a direction of arrangement of the three in-line electron beams in a plane perpendicular to an axis of the color cathode ray tube, the flange having a generally rectangular cross section having an outwardly curved portion at each side thereof in the direction of arrangement of the three in-line electron beams in the plane perpendicular to the axis of the color cathode ray tube, and the flange being formed with a locally thinned-down portion.

In the above configuration, uniform pressures are applied to the whole work piece in press-forming, therefore a cup-shaped electrode with high precision in dimensions and shapes thereof is obtained, and consequently, it is possible to provide a color cathode ray tube superior in characteristics such as withstand voltage characteristics by using this superior cup-shaped electrode.

The present invention is not limited to the above configuration, but various changes and modifications can be made to the above configurations without departing from the nature and spirit of the present invention.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail by reference to the drawings.

Figure 1:
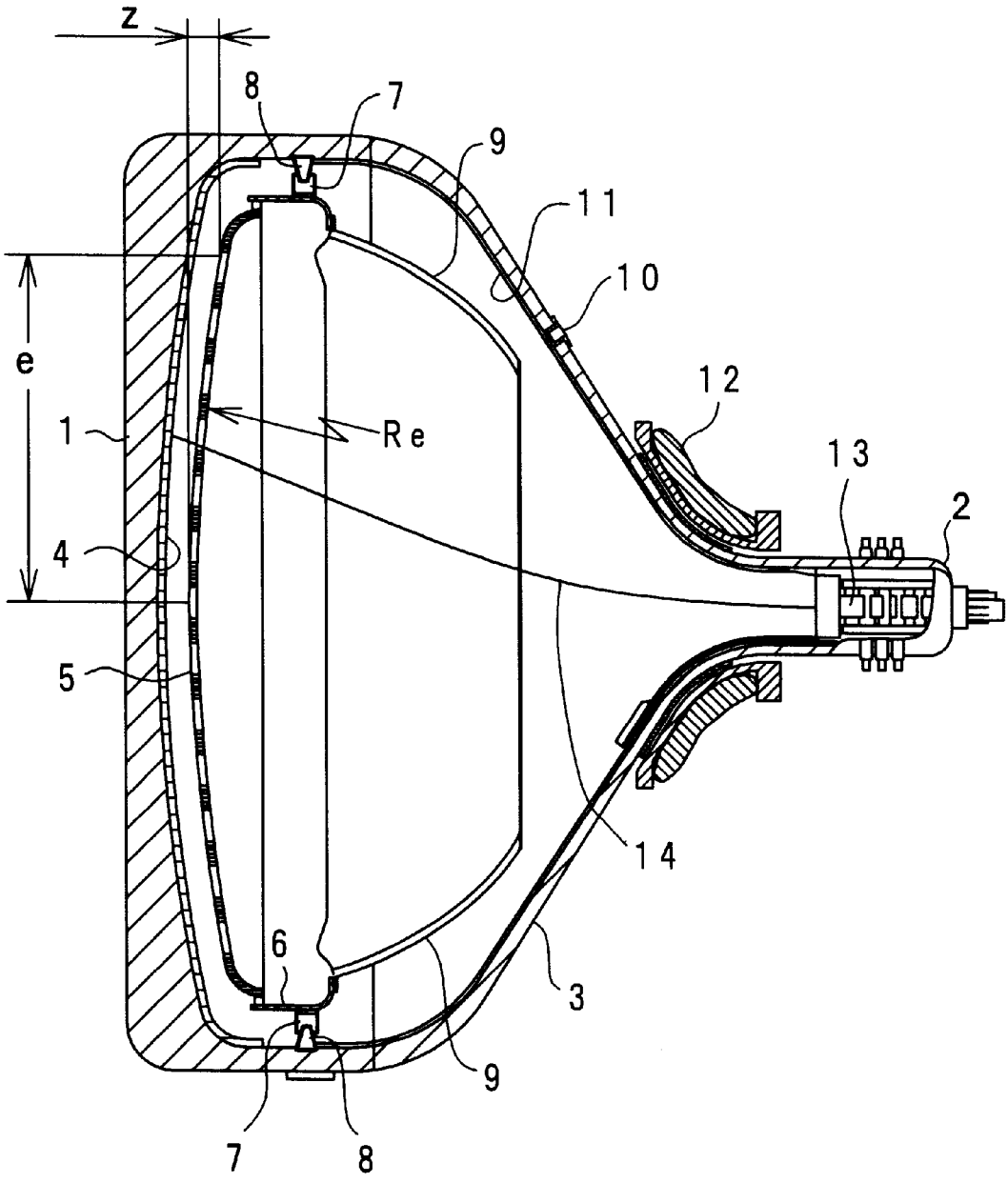
FIG. 1 is a longitudinal cross-sectional view of an embodiment of a shadow mask type color cathode ray tube in accordance with the present invention for explaining its overall structure.

FIG. 1 is a longitudinal cross-sectional view of an embodiment of a shadow mask type color cathode ray tube in accordance with the present invention for explaining its overall structure. In FIG. 1, reference numeral 1 denotes a panel portion, 2 is a neck portion, 3 is a funnel portion, 4 is a phosphor film constituting a screen, 5 is shadow mask having a large number of electron beam apertures therein and serving as a color selection electrode, which is disposed coaxially with the phosphor film 4 and is spaced a predetermined distance from the phosphor film 4. Reference numeral 6 denotes a mask frame which holds the shadow mask 5 and others with a structure to be described subsequently.

Reference numeral 7 are springs, 8 are panel pins, 9 is a magnetic shield, 10 is an anode button, 11 is an internal conductive coating, 12 is a deflection yoke for deflecting electron beams horizontally and vertically, 13 is an electron gun for emitting three electron beams 14 (a center electron beam and two side electron beams). The electron gun 13 employs a cup-shaped electrode formed with precision to be described subsequently, and interelectrode spacings and concentricity between the electron beam apertures in the opposing ends of the electrodes are ensured with high precision.

The mask frame 6 having the shadow mask 5 and the magnetic shield 9 fixed thereto is mounted on the panel pins 8 via the springs 7 within a bulb comprised of the panel portion 1 having the phosphor film 4 on its inner surface and the funnel portion 3, then the panel portion 1 and the funnel portion 3 are joined together with fused frit glass, the electron gun 13 is sealed into the neck portion 2, and the envelope formed of the panel portion 1, the funnel portion 3 and the neck portion 2 is vacuum-sealed.

The electron beams 14 emitted from the electron gun 13 are deflected horizontally and vertically by the deflection yoke 12 mounted around the transition region between the neck portion 2 and the funnel portion 3, and then pass through electron beam apertures in the shadow mask 5 serving as the color selection electrode and impinge upon the phosphor film 4 to form images.

As color TV receivers and color display monitors of a flat-screen type spread recently, there is a tendency for the faceplate (the panel glass) to be made flat in color cathode ray tubes used for those.

The embodiment of the present invention shown in FIG. 1 is a shadow mask type color cathode ray tube of the flat-screen type. In FIG. 1, the outer surface of the panel portion 1 is approximately flat, and its inner surface is concavely curved. The shadow mask 5 is fabricated by press-forming a shadow mask blank into a shape having a desired curvature conforming to the inner surface of the panel portion 1.

The reason why the inner surface of the panel portion 1 and the shadow mask 5 are curved irrespective of the approximately flat outer surface of the panel portion 1 is that a method of fabricating the shadow mask 5 by a press-forming technique is simple and the cost of the shadow mask 5 is low.

A major surface of the shadow mask 5 including an apertured area formed with a large number of electron beam apertures is approximately rectangular, has different radiuses of curvature along the major axis, the minor axis and the diagonals, of the major surface, respectively. This is intended to obtain the compatibility of creation of a sense that a picture on the screen of the color cathode ray tube is flat with the maintenance of mechanical strength of the formed shadow mask.

The curvature of the shadow mask 5 in the present embodiment is aspheric, and the radiuses of curvature of the shadow mask 5 decrease gradually with increasing distance from the center of the major surface of the shadow mask 5 toward the peripheries of the major surface, along the major axis, the minor axis and the diagonals of the major surface, respectively. The radius Rx of curvature along the major axis varies from 1450 mm to 1250 mm, the radius Ry of curvature along the minor axis varies from 2000 mm to 1300 mm, and the radius Rd of curvature along the diagonals varies from 1600 mm to 1250 mm.

The radius of curvature of this aspheric shadow mask can be defined as the following equivalent radius Re of curvature:

$$Re=(z^2+e^2)/(2z)$$

where e (mm) is a distance between the center of the major surface of the shadow mask and an arbitrary peripheral position of the major surface, measured perpendicularly to the tube axis, and z (mm) is a distance between the arbitrary peripheral position and a plane passing through the center of the major surface and perpendicular to the tube axis.

As described above, even if the radius along the major axis is somewhat smaller than that along the minor axis, this does not impair the sense that a picture on the screen of the color cathode ray tube is flat, and the equivalent radius of curvature equal to or more than 1250 mm is sufficient for the purpose.

In a color cathode ray tube of the present invention shown in FIG. 1, a cup-shaped electrode in an electron gun is fabricated with higher precision than that in a prior art color cathode ray tube, and interelectrode spacings and concentricity between the electron beam apertures in the opposing ends of the electrodes are ensured with high precision. Therefore the color cathode ray tube of the present invention is superior in withstand voltage characteristics and is capable of displaying a high-resolution color image.

Figure 2A:
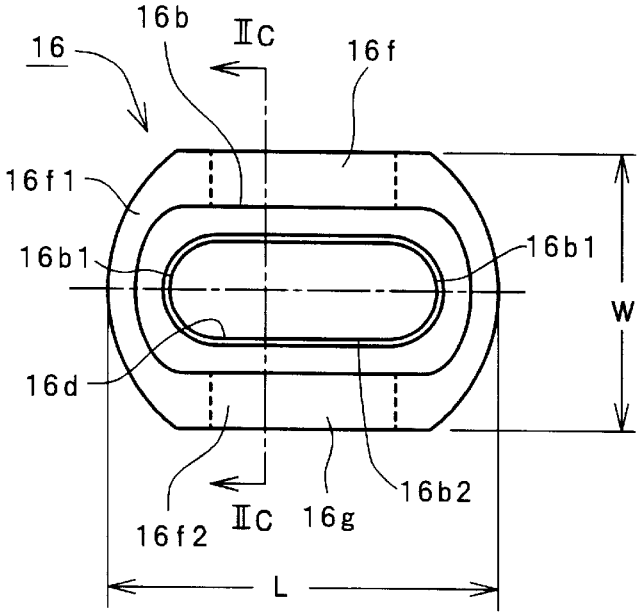
FIGS. 2A to 2C are illustrations of an embodiment of a cup-shaped electrode used for a color cathode ray tube of the present invention, FIG. 2A being a plan view of the cup-shaped electrode, FIG. 2B being a front view thereof and FIG. 2C being a cross-sectional view of the cup-shaped electrode taken along line IIC—IIC of FIG. 2A.
Figure 2C:
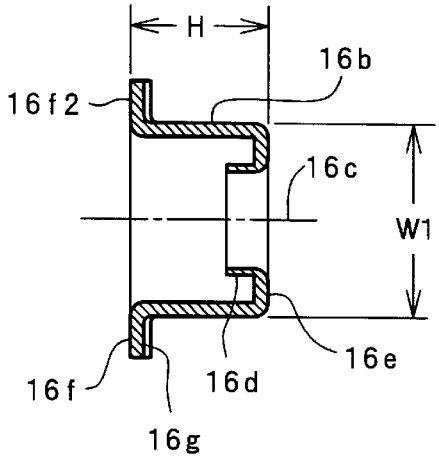
Figure 2B:
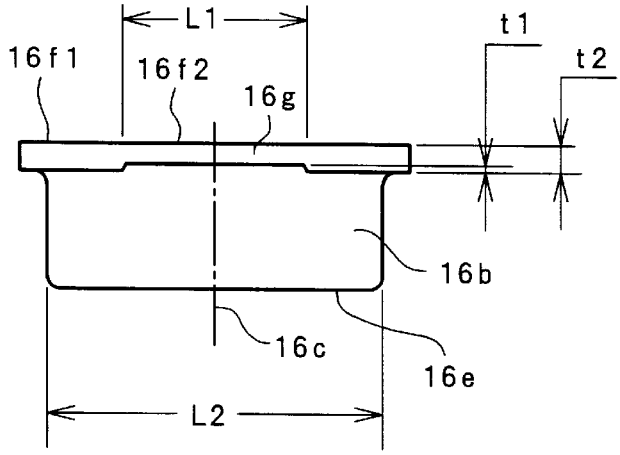

FIGS. 2A to 2C are illustrations for explaining an embodiment of a cup-shaped electrode used for an embodiment of a color cathode ray tube in accordance with the present invention shown in FIG. 1, FIG. 2A is a plan view of the cup-shaped electrode, FIG. 2B is a front view thereof and FIG. 2C is a cross-sectional view of the cup-shaped electrode taken along line IIC—IIC of FIG. 2A.

As shown in FIGS. 2A to 2C, the cup-shaped electrode 16 has a generally rectangular flange 16*f* and a tubular portion 16*b* rising approximately perpendicularly and continuously from the flange 16*f*. The tubular portion 16 has a generally rectangular cross section having an outwardly curved portion at each side thereof in a direction of arrangement of the three in-line electron beams in a plane perpendicular to an axis of the color cathode ray tube. The tubular portion 16*b* has an approximately oval opening in a cross section perpendicular to an axis 16*c* of the tubular portion 16*b*, that is, an approximately oval opening of the shape having two arcs 16*b*1 at both ends thereof and two straight lines 16*b*2 at the central portions joining the two arcs 16*b*1. The three electron beams pass through the approximately oval opening. Reference numeral denotes 16*d* denotes a turned-up portion, which is turned up inwardly from a top surface 16*e* of the tubular portion 16*b* to extend toward the flange 16*f*. In some cup-shaped electrodes, the turned-up portion 16*d* is omitted.

The flange 16*f* comprises arc-shaped flange portions 16*f*1 and straight flange portions 16*f*2 which are formed outside of the tubular portion 16*b*. Reference numeral 16*g* denotes thinned-down portions, and the thinned-down portions 16*g* are formed over the approximately entire area of the straight flange portions 16*f*2 such that the thickness and the length of the thinned-down portions 16*g* are t1 and L1, respectively. The thickness t1 of the thinned-down portions 16*g* is chosen to be smaller than the thickness t2 of the arc-shaped flange portions 16*f*1.

Various values of a difference between the thickness t1 and the thickness t2 are chosen depending upon the size of the flange 16*f*, the height of the tubular portion 16*b*, and others. It is preferable that the difference between the thickness t1 and the thickness t2 is in a range of 5 to 8% of the thickness t2.

The length L1 of the thinned-down portion 16*g* extends over the approximately entire length of the straight flange portions 16*f*2 in FIGS. 2A and 2B, but various values of the length L1 are also chosen depending upon the size of the flange 16*f*, the height of the tubular portion 16*b*, and others as in the case of the thickness t1.

Usually the cup-shaped electrode is fabricated from a material of thickness in a range of 0.24 mm to 0.5 mm.

A specific example of the above-explained dimensions are as follows:

The length L of the flange 16*f*=22 mm, the width W of the flange 16*f*=15.9 mm, the height H of the tubular portion 16*b*=7 mm, the length L2 of the tubular portion 16*b*=21.2 mm, the width W1 of the tubular portion 16*b*=11.12 mm, the thickness t1 of the thinned-down portions 16*g*=0.33 mm, the thickness t2 of the arc-shaped flange portions 16*f*1=0.35 mm, and the length L1 of the thinned-down portions 16*g*=11 mm.

Figure 3:
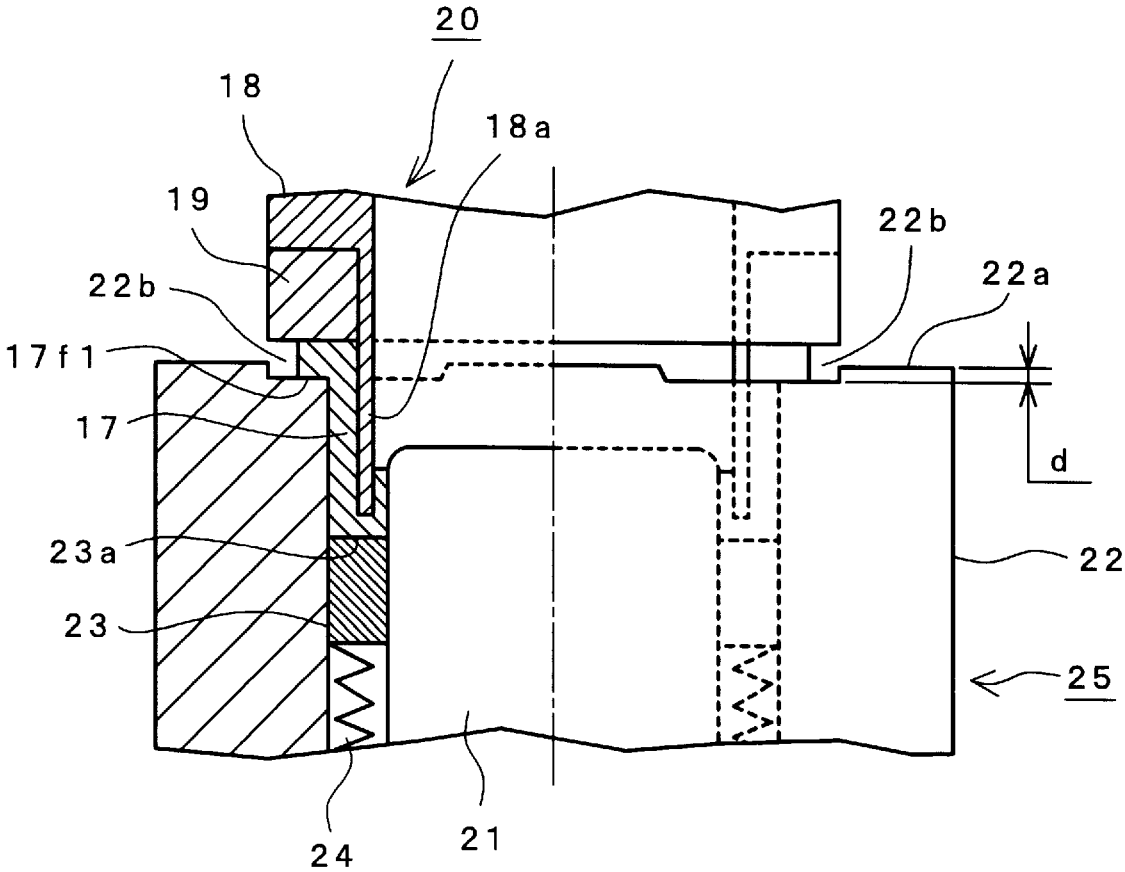
FIG. 3 is a partially broken-away front view of a press-forming condition for explaining a step for fabricating the cup-shaped electrode used in an embodiment of the present invention.

FIG. 3 is a partially broken-away front view of a press-forming condition for explaining an example of the steps for fabricating the cup-shaped electrode shown in FIGS. 2A to 2C and used in an embodiment of the present invention.

Now an example of a press-forming (sizing) step will be explained by referring to FIG. 3. The same names as utilized in connection with FIGS. 2A–2C designate functionally similar parts or portions in FIG. 3. In FIG. 3, Reference 17 denotes a work piece. The work piece 17 is drawn into the shape of a cup, then is subjected to heat treatment, and then is press-formed into final shape. Reference numeral 18 denotes a first sizing die, 19 is a second sizing die, and the first and second sizing dies 18, 19 are fastened together with bolts to form an upper die. Reference numeral 21 denotes a sizing punch, 22 is a guide formed with grooves 22*b* having a depth d and a width corresponding to that of arc-shaped flange portions 17*f*1 of the work piece 17 on the top surface 22*a* of the guide 22.

The depth d of the grooves 22*b* is about 0.02 mm, for example, and it is determined in consideration of the above-described difference between the thickness t1 and the thickness t2. The width of the groove 22*b* is about 8 mm, for example.

Reference numeral 23 denotes a knock-out, 24 are springs in contact with the knock-out 23 for supporting it. Reference 25 denotes a lower die comprised of the sizing punch 21, the guide 22, and others.

The following explains the press-forming (sizing) step. First, after being drawn and then subjected to a high-temperature heat treatment in a hydrogen atmosphere, the work piece 17 is placed on the lower die 25. Here a top surface 23*a* of the knock-out 23 is raised until the top surface 23*a* is level with the bottom surface of the groove 22*b* of the guide 22 and then is stopped there. On the other hand, the upper die 20 is lowered such that a tubular portion 18*a* of the first sizing die 18 and the knock-out 23 sandwich the work piece 17 therebetween, and then keeping this condition, the upper die 20 is further lowered to the work piece 17 into the guide 22. In this operation, the sizing punch 21 is inserted into the inside of the work piece 17, the upper die 20 is further lowered, and finally it reaches a lower limit condition and completes the sizing step.

This sizing step produces a difference in thickness between the arc-shaped flange portions and the straight flange portions of the cup-shaped electrode.

Figure 4A:
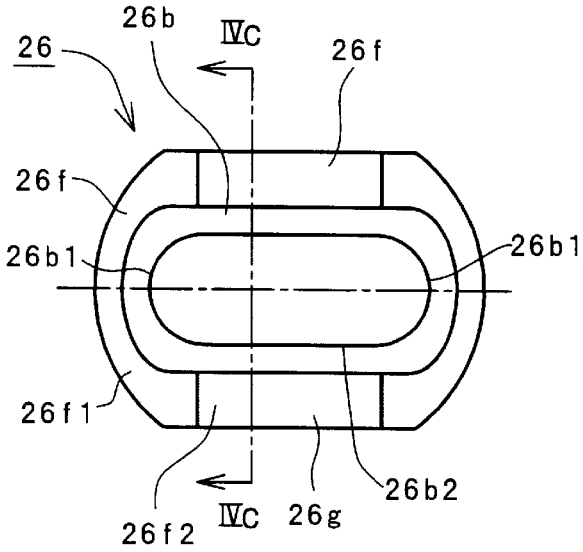
FIGS. 4A to 4C are illustrations of another embodiment of a cup-shaped electrode used for a color cathode ray tube of the present invention, FIG. 4A being a plan view of the cup-shaped electrode, FIG. 4B being a partially broken-away front view thereof and FIG. 4C being a cross-sectional view of the cup-shaped electrode taken along line IVC—IVC of FIG. 4A.
Figure 4C:
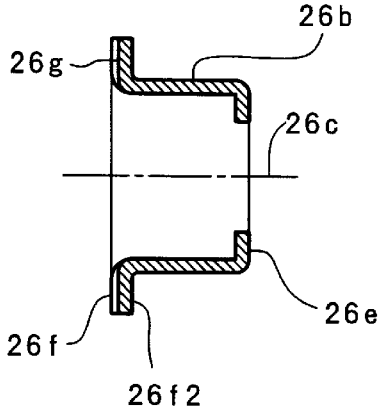
Figure 4B:
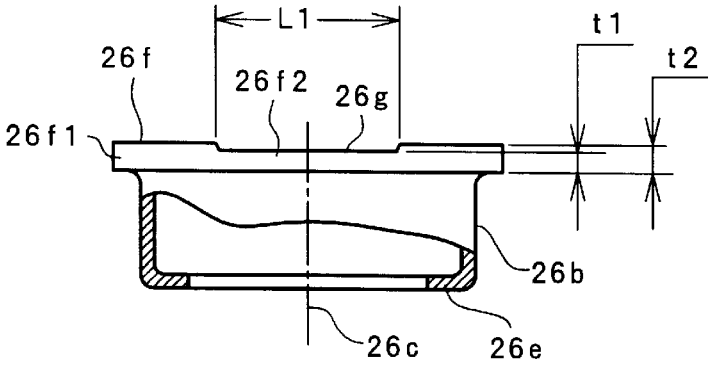
Figure 5:
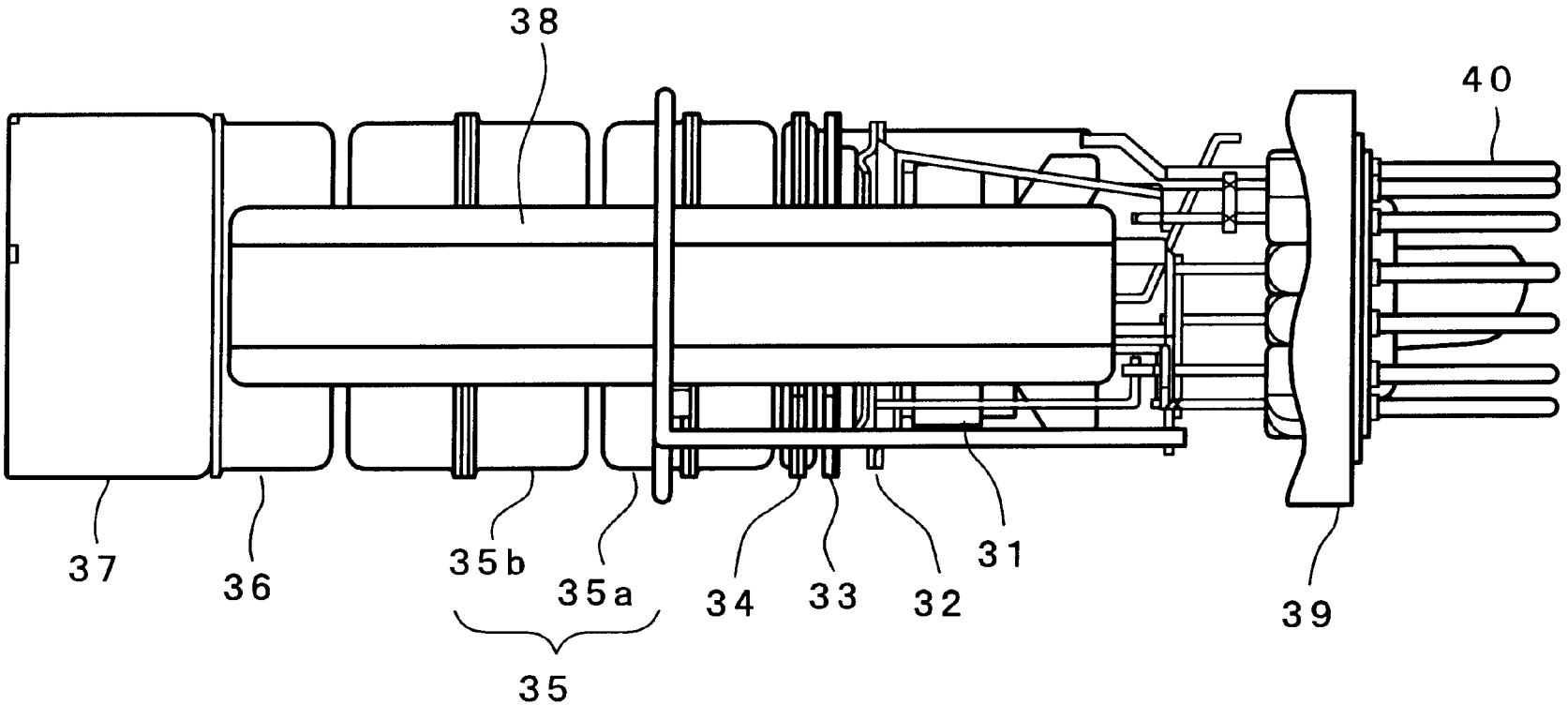
FIG. 5 is a side view of an essential part of an example of a configuration of an in-line type electron gun used in a color cathode ray tube to which the present invention is applicable.
Figure 6A:
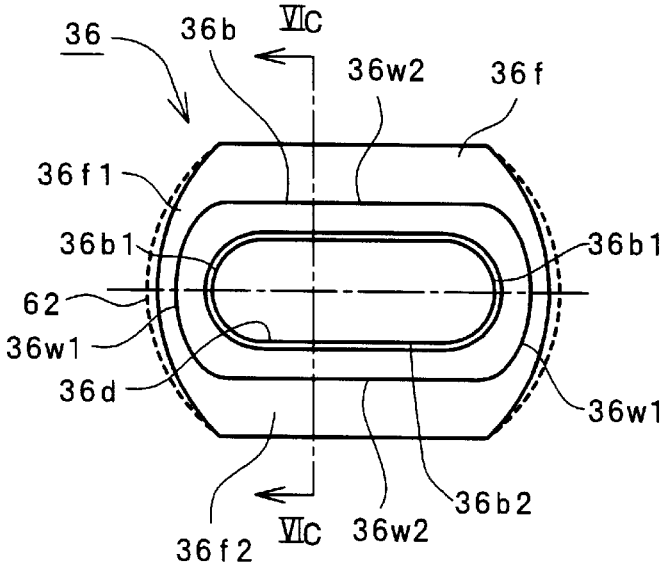
FIG. 6A (PRIOR ART)
FIGS. 6A to 6C are illustrations of a prior art cup-shaped electrode used for a color cathode ray tube, FIG. 6A being a plan view of the prior art cup-shaped electrode, FIG. 6B being a front view thereof and FIG. 6C being a cross-sectional view of the prior art cup-shaped electrode taken along line VIC—VIC of FIG. 6A.
Figure 6C:
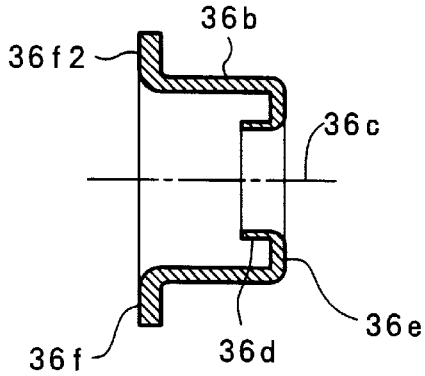
FIG. 6C (PRIOR ART)
Figure 6B:
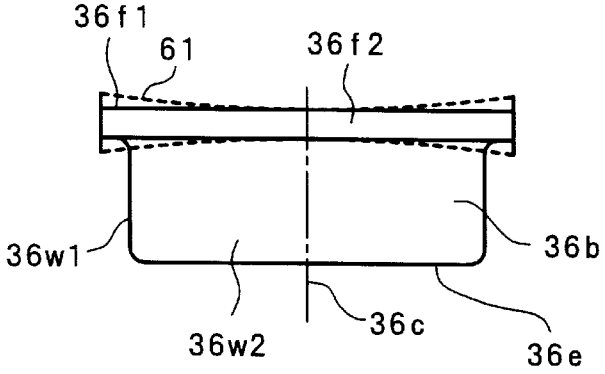
FIG. 6B (PRIOR ART)

FIGS. 4A to 4C are illustrations of another embodiment of a cup-shaped electrode used for a color cathode ray tube of the present invention as shown in FIG. 1, FIG. 4A is a plan view of the cup-shaped electrode, FIG. 4B is a partially broken-away front view thereof, and FIG. 4C is a cross-sectional view of the cup-shaped electrode taken along line IVC—IVC of FIG. 4A.

As shown in FIGS. 4A to 4C, a cup-shaped electrode 26 has a generally rectangular flange 26*f* and a tubular portion 26*b* rising approximately perpendicularly and continuously from the flange 26*f*. The tubular portion 16 has a generally rectangular cross section having an outwardly curved portion at each side thereof in a direction of arrangement of the three in-line electron beams in a plane perpendicular to an axis of the color cathode ray tube. The tubular portion 26*b* has an approximately oval opening in a cross section perpendicular to an axis 26*c* of the tubular portion 26*b*, that is, an approximately oval opening of the shape having two arcs 26*b*1 at both ends thereof and two straight lines 26*b*2 at the central portions joining the two arcs 26*b*1. The three electron beams pass through the approximately oval opening.

The flange 26*f* comprises arc-shaped flange portions 26*f*1 and straight flange portions 26*f*2 which are formed outside of the tubular portion 26*b*. Reference numeral 26*g* denotes thinned-down portions, and the thinned-down portions 26*g* are formed over the approximately entire area of the straight flange portions 26*f*2 such that the thickness and the length of the thinned-down portions 26*g* are t1 and L1, respectively. The thickness t1 of the thinned-down portions 26*g* is chosen to be smaller than the thickness t2 of the arc-shaped flange portions 26*f*1.

This embodiment of the invention is similar to that shown in FIGS. 2A to 2C except that there is no turned-up portion turned up inwardly from the top surface 26*e* of the tubular portion 26*b* toward the flange 26*f*, and the thinned-down portions 26*g* is formed by depressing a central portion of a surface of the straight flange portions 26*f*2 on the side opposite from the tubular portion 26*b*.

With this configuration in which the thinned-down portions 26*g* is formed by depressing the central portion of the surface of the straight flange portions 26*f*2 on the side opposite from the tubular portion 26*b*, another advantage is obtained that measuring accuracy of the component is further improved because this configuration reduces the contact area between a measuring instrument and a surface of the component on a side opposite from a bottom surface of the component which serves as a reference plane for measuring dimensions of the component.

It is needless to say that the present invention is not limited to the color cathode ray tube as described above, but the present invention is also applicable to other type of color cathode ray tubes employing an in-line three-beam electron gun.

As explained above, in accordance with the present invention, a cup-shaped electrode among a plurality of electrodes constituting an electron gun is fabricated with high precision, and by using such a cup-shaped electrode interelectrode spacings and concentricity between the electron beam apertures in the opposing ends of the electrodes are ensured with high precision, and consequently, reliability of the electron gun itself is improved greatly, and incorporation of the thus superior electron gun provides a highly-reliable, high-quality, long-life color cathode ray tube superior in withstand voltage characteristics and capable of displaying a high-resolution color image.

What is claimed is:

1. A color cathode ray tube comprising a vacuum envelope including a panel portion, a neck portion and a funnel portion for connecting said panel portion and said neck portion, a phosphor screen formed on an inner surface of said panel portion, and an electron gun housed in said neck portion;

said electron gun comprising an electron beam generating section having a cathode, an electron beam control electrode and an accelerating electrode arranged in the order named for emitting three in-line electron beams toward said phosphor screen, and an electron beam focusing section for focusing said three in-line electron beams from said electron beam generating section onto said phosphor screen, said electron beam generating section and said electron beam focusing section being mounted in predetermined spaced relationship on a plurality of insulator support rods, said electron beam focusing section including at least one cup-shaped electrode having a tubular portion and a flange formed continuously from said tubular portion, said tubular portion having a generally rectangular cross section having an outwardly curved portion at each side thereof in a direction of arrangement of said three in-line electron beams in a plane perpendicular to an axis of said color cathode ray tube, said flange having a generally rectangular cross section having an outwardly curved portion at each side thereof in the direction of arrangement of said three in-line electron beams in the plane perpendicular to the axis of said color cathode ray tube, and said flange being formed with a locally thinned-down portion.

2. A color cathode ray tube according to claim 1, wherein said locally thinned-down portion is provided between said outwardly curved portions of said flange.

3. A color cathode ray tube according to claim 1, wherein a thickness of said locally thinned-down portion is smaller by 5 to 8% of a thickness of said outwardly curved portions of said flange than said thickness of said outwardly curved portions of said flange.

4. A color cathode ray tube according to claim 2, wherein a thickness of said locally thinned-down portion is smaller by 5 to 8% of a thickness of said outwardly curved portions of said flange than said thickness of said outwardly curved portions of said flange.

5. A color cathode ray tube according to claim 1, wherein said at least one cup-shaped electrode is fabricated from a material in a range of 0.24 mm to 0.5 mm in thickness.

6. A color cathode ray tube according to claim 2, wherein said at least one cup-shaped electrode is fabricated from a material in a range of 0.24 mm to 0.5 mm in thickness.

7. A color cathode ray tube according to claim 1, wherein said locally thinned-down portion is formed by depressing a surface of said flange on a tubular portion side thereof.

8. A color cathode ray tube according to claim 2, wherein said locally thinned-down portion is formed by depressing a surface of said flange on a tubular portion side thereof.

9. A color cathode ray tube according to claim 1, wherein said locally thinned-down portion is formed by depressing a surface of said flange on a side thereof opposite from said tubular portion.

10. A color cathode ray tube according to claim 2, wherein said locally thinned-down portion is formed by depressing a surface of said flange on a side thereof opposite from said tubular portion.

* * * * *